US007484871B2

(12) United States Patent
Boxler

(10) Patent No.: US 7,484,871 B2
(45) Date of Patent: Feb. 3, 2009

(54) SINGLE LENS FOR LED SIGNAL LIGHT

(75) Inventor: Lawrence H. Boxler, Columbus, IN (US)

(73) Assignee: Valeo Sylvania LLC, Seymour, IN (US)

( * ) Notice: Subject to any disclaimer, the term of this patent is extended or adjusted under 35 U.S.C. 154(b) by 476 days.

(21) Appl. No.: 10/879,953

(22) Filed: Jun. 29, 2004

(65) Prior Publication Data

US 2005/0024887 A1 Feb. 3, 2005

Related U.S. Application Data

(60) Provisional application No. 60/490,848, filed on Jul. 29, 2003.

(51) Int. Cl.
*F21V 5/02* (2006.01)

(52) U.S. Cl. ..... 362/545; 362/520; 362/333; 362/339; 359/619; 359/742

(58) Field of Classification Search ..... 362/520, 362/545, 326, 333, 339, 522, 336, 337; 359/619–629, 359/742, 743, 542
See application file for complete search history.

(56) References Cited

U.S. PATENT DOCUMENTS

| | | | | | |
|---|---|---|---|---|---|
| 4,722,023 | A * | 1/1988 | Arima et al. | 362/503 |
| 4,823,246 | A * | 4/1989 | Dilouya | 362/328 |
| 4,868,725 | A * | 9/1989 | Sakagawa et al. | 362/231 |
| 5,206,761 | A * | 4/1993 | Ogino | 359/457 |
| 5,321,417 | A * | 6/1994 | Voelzke et al. | 345/32 |
| 5,436,762 | A * | 7/1995 | Duneau | 359/535 |
| 5,477,380 | A * | 12/1995 | Watanabe et al. | 359/457 |
| 5,664,874 | A * | 9/1997 | Winterer | 362/191 |
| 5,964,525 | A * | 10/1999 | Albou | 362/522 |
| 6,161,952 | A * | 12/2000 | Schuster et al. | 362/539 |
| 6,273,591 | B1 * | 8/2001 | Albou | 362/333 |
| 6,305,830 | B1 * | 10/2001 | Zwick et al. | 362/520 |
| 6,352,359 | B1 * | 3/2002 | Shie et al. | 362/522 |
| 6,398,988 | B1 * | 6/2002 | Jenkins et al. | 264/2.2 |
| 7,059,754 | B2 * | 6/2006 | Lekson et al. | 362/545 |
| 2002/0071267 | A1 * | 6/2002 | Lekson et al. | 362/31 |
| 2004/0208018 | A1 * | 10/2004 | Sayers et al. | 362/544 |

FOREIGN PATENT DOCUMENTS

| | | | |
|---|---|---|---|
| DE | 19507234 | | 9/1996 |
| EP | 0 869 312 | | 10/1998 |
| EP | 1 026 033 | | 8/2000 |
| JP | 61-77832 | * | 4/1986 |
| JP | 190149 | * | 7/1996 |
| WO | WO 00/10835 | | 3/2000 |
| WO | WO 00/71417 | | 11/2000 |

* cited by examiner

*Primary Examiner*—Stephen F. Husar
*Assistant Examiner*—Peggy A. Neils
(74) *Attorney, Agent, or Firm*—William E. Meyer

(57) ABSTRACT

A lens 10 comprises a first surface 12 and a second surface 14. The first surface 12 is provided with a plurality of horizontal, linear Fresnel lenses 16 and the second surface 14 is provided with a plurality of horizontal pillow optics 18. In the lens 10 the horizontal, linear Fresnel lenses 16 of the first surface 12 provide vertical refraction of light from a central axis sufficient to collimate light from a point to within ±70 degrees of horizontal and the pillow optics 18 of the second surface provide horizontal spread of the collimated light to ±25 degrees from the medial plane.

3 Claims, 5 Drawing Sheets

SINGLE LENS FOR LED SIGNAL LIGHT

CROSS-REFERENCE TO RELATED APPLICATION

This application claims priority from Provisional Application No. 60/490,848, filed Jul. 29, 2003.

TECHNICAL FIELD

This application relates to lenses and more particularly to lenses for automotive signal lamps. Still more particularly, it relates to lenses for signal lamps employing light emitting diodes as the light source.

BACKGROUND ART

In a conventional optical system utilizing light emitting diodes (LED or LEDs) as the light source and only a single lens as the optic, the LEDs are aligned so that the central axis of light from the LEDs is pointed at the center of the field to be illuminated and the lens is perpendicular to the axis orientation. Formed on the side of the lens facing the LEDs is a Fresnel refractor and formed on the side of the lens facing the field to be illuminated is a series of pillow-type lens elements. The LED light is directed by the Fresnel element in both the horizontal and vertical directions into a collimated beam. The external pillow lens elements then direct the collimated beam into the required vertical and horizontal angular light distributions. The disadvantage of this design is that such a lens may not be perpendicular to the optical axis of the test pattern. This may be due to actual construction or because it is inconvenient to position the lens vertically in the preferred vehicle design. Typically the windows are sloped, thereby requiring a slopped lens face. The circular Fresnel lens collimates light along the axis of the lens tilt rather than the optical axis, which makes the system incapable of meeting light distribution. In the past, if it was desired that a lens tilt not be perpendicular to the optical axis, an additional inner lens piece with the Fresnel or the Fresnel and the pillows that was perpendicular to the optical axis was used. This inner lens increased the cost and reduced the amount of available light.

Center high mount stop lamps (CHMSLs) that used incandescent lamps provided sufficient excess light so that losing some light still allowed the light output to meet legal specifications. However, to use LEDs there is a much greater need to be efficient. At the same time there is a need for standardized lamps systems usable in a variety of vehicles with differing window slopes. LED CHMSLs have been made with lenses provided on the inside surface with one or more circular Fresnel lens area that would receive and collimate the light respectively fro a corresponding LED. The collimated light passed through the lens to the exterior surface where it encountered square, pillow type lens elements the spread the light vertically and horizontally. This lens had to be aligned so that the central, i.e., axial radiation from the LED went through the center of the corresponding Fresnel lens portion and was parallel to the normal axis of the lens. If the lens were positioned so that the LED axis was at an angle to the lens normal, for example, where a user wants the lens to have a different face angle to fit against a window, then the lens would direct light substantially along the axis of tilt. For an LED lamp system there may be too little light to start with so the misdirection amounted to an intolerable light loss from the obligated legal requirements.

DISCLOSURE OF INVENTION

It is, therefore, an object of the invention to obviate the disadvantages of the prior art.

It is another object of the invention to enhance lenses for use with LED light sources.

These objects are accomplished, in one aspect of the invention by an automotive signal lamp comprising a housing having a cavity closed by a lens; a light source positioned within said cavity directed toward said lens; said lens having a first surface facing said light source and a second surface facing a field to be illuminated, said first surface being provided with a plurality of horizontal fresnel lenses and said second surface being provided with a plurality of horizontal pillow optics.

Use of this lens structure allows for the use of a single lens design for an LED that has the lens axis tilted at an angle other than 90 degrees with respect to the optical axis.

BRIEF DESCRIPTION OF THE DRAWINGS

FIG. 5 is a diagrammatic view of the light distribution from a lens of the invention in a horizontal cross-section; and.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
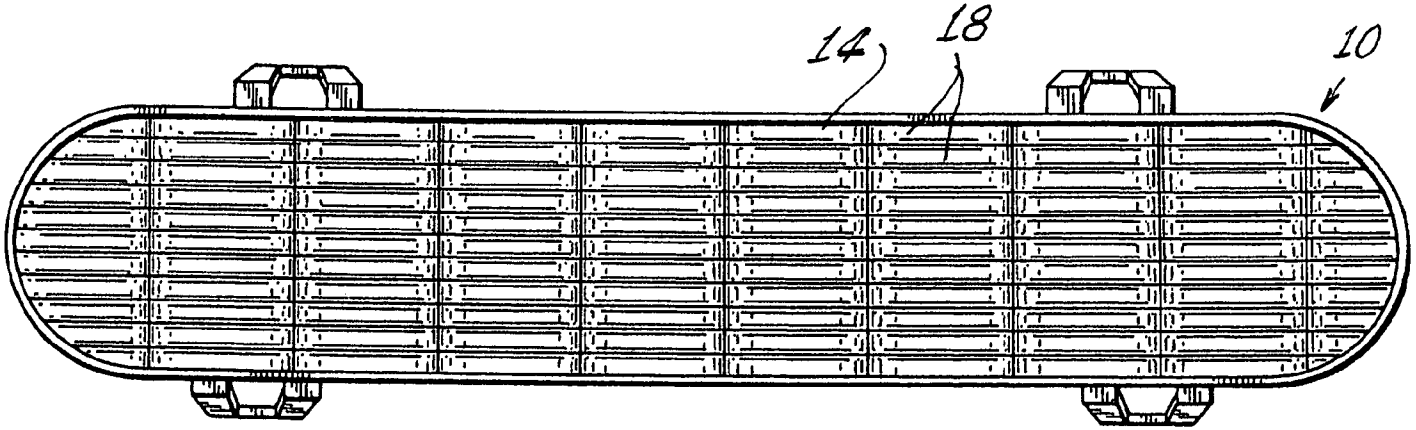
FIG. 1 is an elevational view of the front side of a lens employing an embodiment of the invention.
Figure 2:
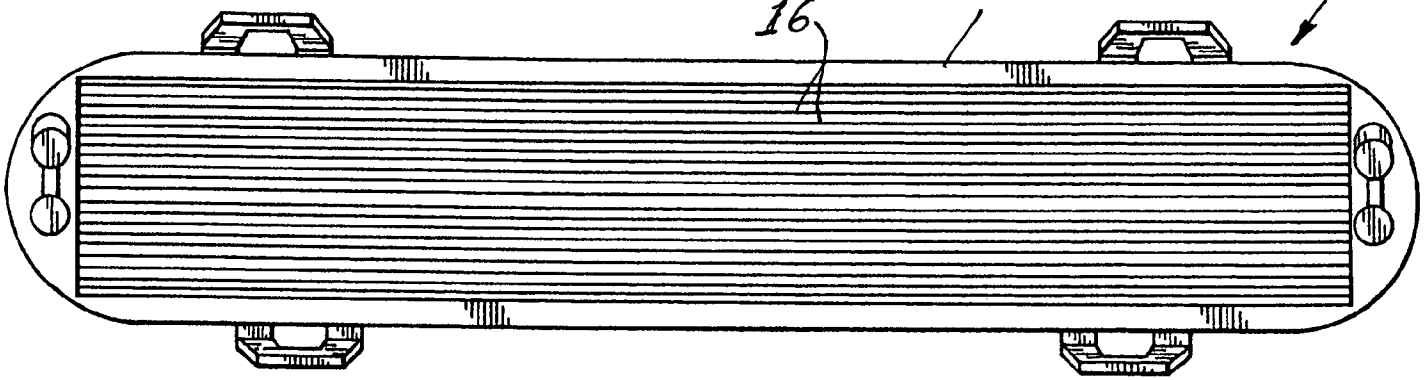
FIG. 2 is an elevational view of the rear or lamp side of a lens employing an embodiment of the invention.

Referring now to the drawings with greater particularity, there is shown in FIGS. 1 and 2 a lens 10 comprising a first surface 12 and a second surface 14. The first surface 12 is provided with a plurality of horizontal, linear Fresnel lenses 16 and the second surface 14 is provided with a plurality of horizontal pillow optics 18.

In the lens 10 the horizontal, linear fresnel lenses 16 of the first surface 12 provide vertical refraction of light from a central axis sufficient to collimate light from a point to within ±70 degrees of the optical axis and the pillow optics 18 of the second surface provide both vertical spread to ±12 degrees and horizontal spread of the light from a point to within ±70 degrees of the optical axis to ±25 degrees from the medial plane.

In a preferred embodiment of the invention the lens is employed with an automotive signal lamp 30. (See FIG. 5). The lamp 30 comprises a housing 32 having a cavity 34 closed by the lens 10. A light source 36 such as a light emitting diode is positioned within the cavity and directed toward the lens 10. The lens has a first surface 12 facing the light source 36 and a second surface 14 facing a field to be illuminated. The first surface 12 is provided with the plurality of horizontal Fresnel lenses 16 and the second surface 14 is provided with the plurality of horizontal pillow optics 18.

Figure 3:
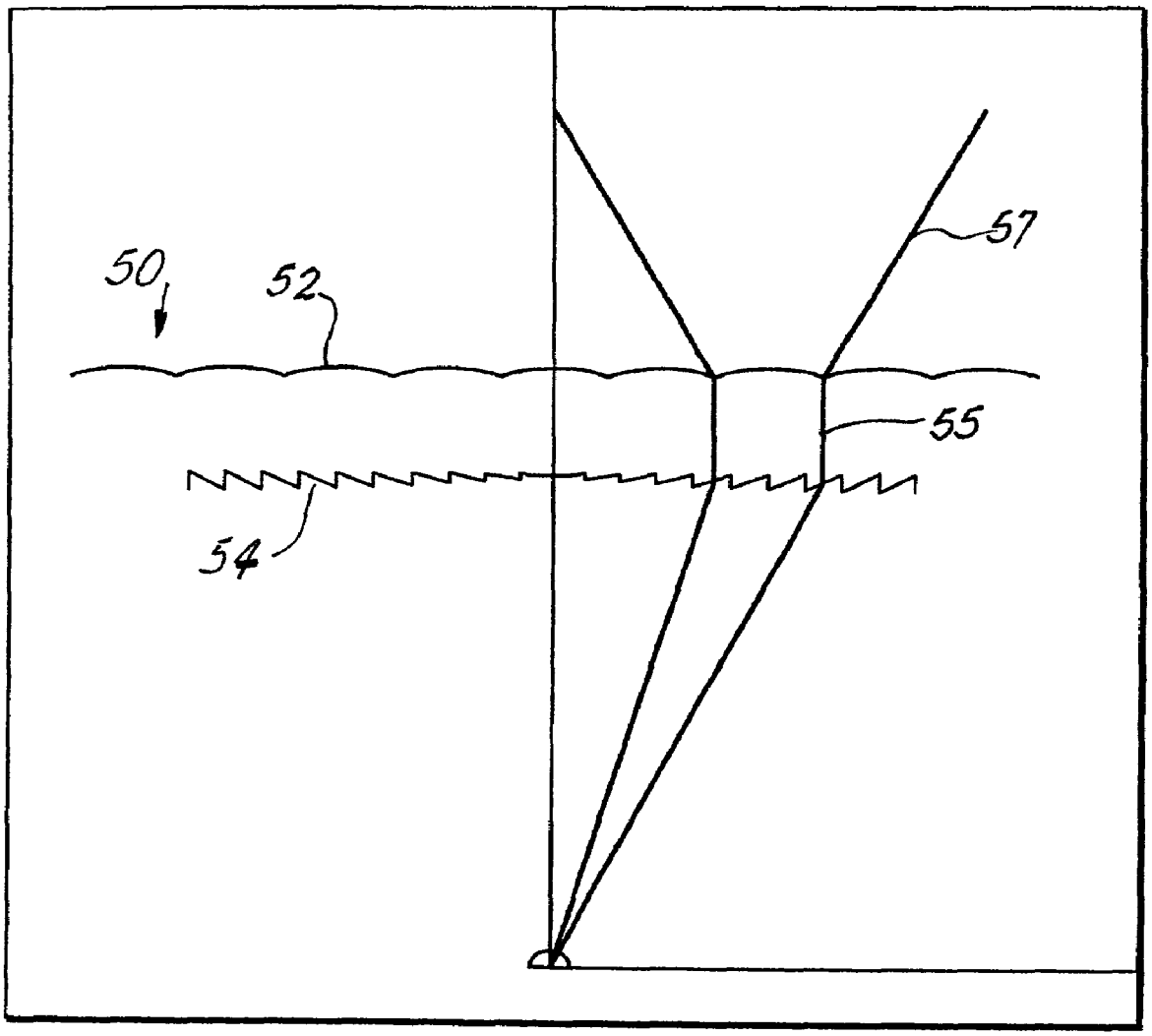
Prior Art Fig. 3
FIG. 3 is a diagrammatic view of the light distribution from a prior art lens.
Figure 4:
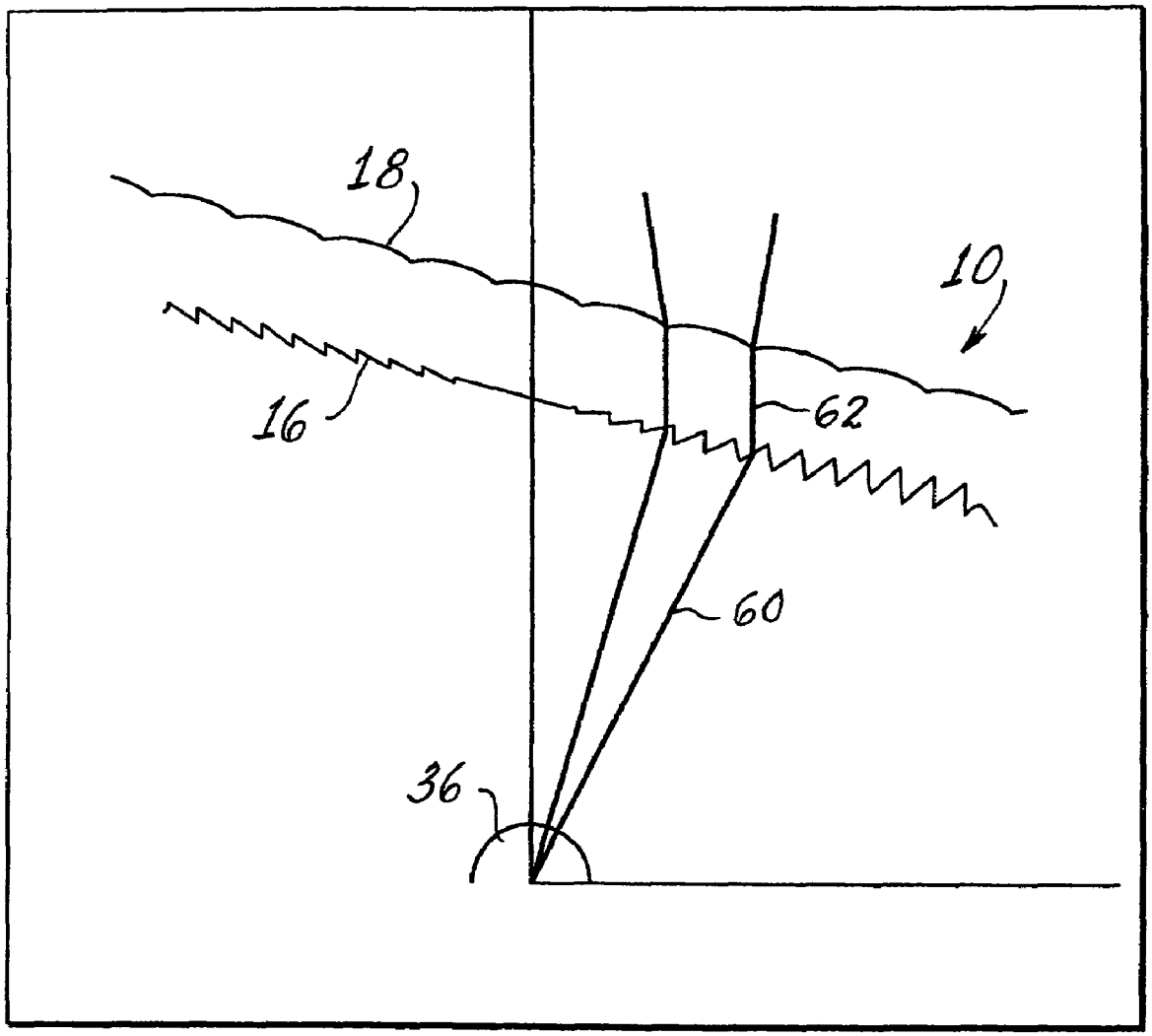
FIG. 4 is a diagrammatic view of the light distribution from a lens of the invention taken in a vertical cross-section.
Figure 5:
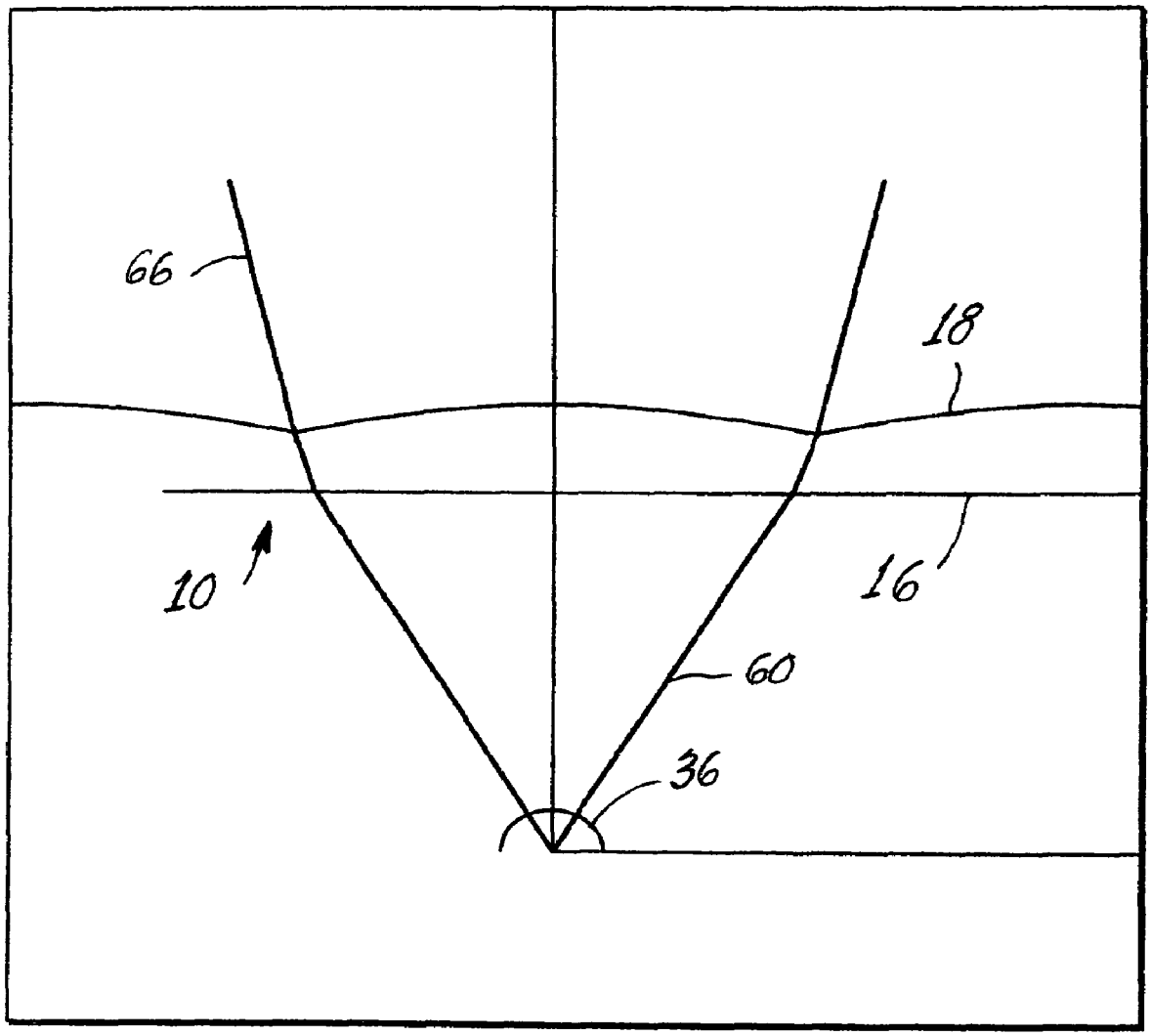
Figure 6:
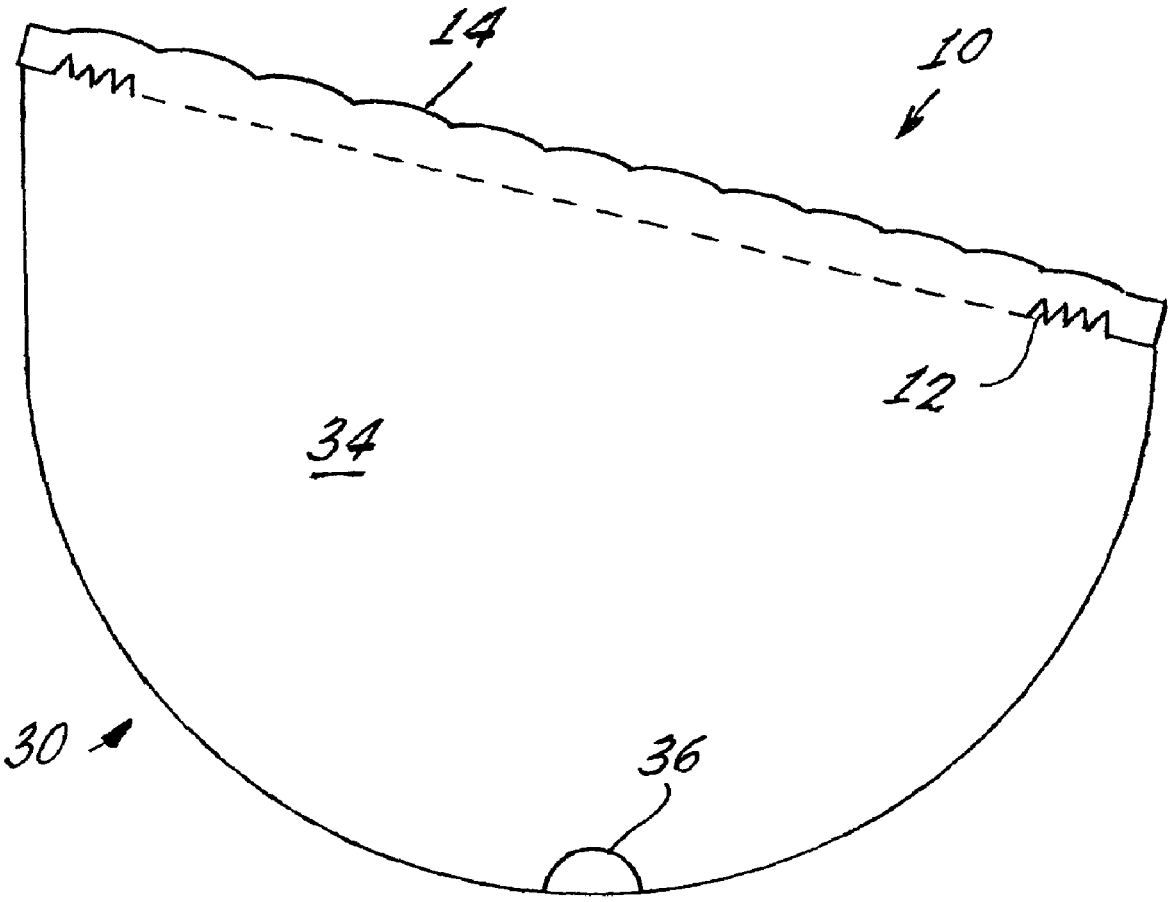
FIG. 6 is a diagrammatic view of an automotive signal lamp.

For a better understanding of the operation of the lens 10, reference is directed to FIGS. 3-5. FIG. 3 displays a prior art lens 50 having pillow lenses 52 and circular Fresnel lenses 54. In this conventional LED-lens only optical system, the light is directed by the Fresnel element in both the horizontal and vertical directions into a collimated beam 55. The external pillow lenses 52 are then used to direct the collimated beam into the required signal lamp distribution 57. The disadvantage of this design occurs if the lens is not perpendicular to the optical axis of the test pattern. The circular Fresnel lens will collimate light along the axis of the lens tilt rather than the optical axis, which will make the system incapable of meeting the required light distribution. To correct this problem, if it were desired to have a lens tilt that was not perpendicular to the optical axis, an additional inner lens piece with fresnel or fresnel and pillows that were perpendicular to the optical axis was employed, thus adding to the cost of the assembly.

In the lens of the invention, the lens 10 can be set an angle of other than 90° as shown in the vertical cross-section in FIG. 4. Therein the beam 60 from the light source 36 is collimated as at 62 by the linear Fresnel lenses 16 to a directed pattern 64. In the horizontal cross-section shown in FIG. 5 the effect of the linear fresnel lenses can be seen on the improved directed light pattern 66.

Thus there is provided a single lens for an LED source to be used in multiple automotive applications at a greatly reduced cost and with fewer parts than required by the prior art.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An automotive signal lamp comprising:

a housing having a cavity closed by a lens;

a light source positioned within said cavity directed toward said lens;

said lens having a first surface facing said light source and a second surface facing a field to be illuminated, said first surface being provided with a plurality of linear horizontal Fresnel lenses each of said plurality of horizontal Fresnel lenses extending in an uninterrupted line from a first end of said lens to a second end of said lens and said second surface being provided with a plurality of horizontal pillow optics.

2. The automotive signal lamp of claim 1 wherein said light source comprises at least one light emitting diode.

3. The automotive signal lamp of claim 1 wherein said first surface provides vertical refraction of light from a central axis sufficient to collimate light from a point to within ±70 degrees of the optical axis and said pillow optics provides both vertical spread to ±12 degrees and horizontal spread of the light from a point to within ±70 degrees of the optical axis to ±25 degrees from a medial plane.

* * * * *